US005708921A

United States Patent [19]

Yagi et al.

[11] Patent Number: 5,708,921

[45] Date of Patent: Jan. 13, 1998

[54] DEVELOPING DEVICE IN AN IMAGE FORMING APPARATUS FOR REMOVING PARTICULATE MATERIAL FROM THE DEVELOPER

[75] Inventors: Masataka Yagi, Okazaki; Tamotsu Sakuraba; Akihiro Kawasaki, both of Toyokawa, all of Japan

[73] Assignee: Minolta Co., Ltd., Osaka, Japan

[21] Appl. No.: 554,710

[22] Filed: Nov. 7, 1995

[30] Foreign Application Priority Data

Nov. 11, 1994 [JP] Japan ..... 6-277539

[51] Int. Cl.[6] ..... G03G 21/00

[52] U.S. Cl. ..... 399/98; 399/149

[58] Field of Search ..... 355/269, 215, 355/30, 245, 296; 399/149, 150, 98

[56] References Cited

U.S. PATENT DOCUMENTS

| | | | |
|---|---|---|---|
| 4,974,030 | 11/1990 | Tokunaga et al. | 355/296 |
| 5,146,285 | 9/1992 | Kikuchi et al. | 355/296 X |
| 5,170,213 | 12/1992 | Yamaguchi et al. | 355/245 X |
| 5,206,691 | 4/1993 | Mizuno et al. | 355/245 X |
| 5,317,370 | 5/1994 | Kohyama et al. | 399/149 X |
| 5,422,219 | 6/1995 | Anzai et al. | 430/122 |
| 5,436,700 | 7/1995 | Kikuchi et al. | 399/150 X |

FOREIGN PATENT DOCUMENTS

| | | |
|---|---|---|
| 61-228478 | 10/1986 | Japan . |
| 3-15085 | 1/1991 | Japan . |
| 3-186872 | 8/1991 | Japan . |
| 4-18576 | 1/1992 | Japan . |
| 5-94093 | 4/1993 | Japan . |

*Primary Examiner*—Arthur T. Grimley
*Assistant Examiner*—Sophia S. Chen
*Attorney, Agent, or Firm*—Burns, Doane, Swecker & Mathis, LLP

[57] ABSTRACT

An image forming apparatus which is provided with a developing device having a rotatable developing member opposite to a rotatable photoreceptor at a developing region for transporting a developer to bring the developer into contact with the photoreceptor at the developing region, and a paper particle removing member provided at a downstream side from the developing region with respect to a rotational direction of the developing member for removing paper particles from the developer held on the developing member.

35 Claims, 5 Drawing Sheets

DEVELOPING DEVICE IN AN IMAGE FORMING APPARATUS FOR REMOVING PARTICULATE MATERIAL FROM THE DEVELOPER

BACKGROUND OF THE INVENTION

1. Field of the Invention

The present invention relates to an image forming apparatus utilizing an electrophotographic process such as a copying machine and a printer.

2. Description of the Related Arts

Conventionally, as disclosed in Japanese Laid-open Patent Application Hei 4-18576, a cleanerless image forming apparatus is provided having a developing device that collects a developer remaining on the surface of the photoreceptor after transfer at the same time when developing an electrostatic latent image formed on the surface of the photoreceptor.

As shown in FIG. 1, in the above-mentioned image forming apparatus, a brush charger 200, an exposure device 300, a developing device 400, a transfer charger 500 and a separation charger 600 are provided on the periphery of a rotatable photoreceptor 100.

The developing device 400 which is a one-component developing device has a flexible developing sleeve 430 provided on the periphery of a rotatable driven roller 420. Toner T is supplied onto the developing sleeve 430 by means of a toner supply roller 470. The toner T supplied to the developing sleeve 430 is transported to a restricting blade 450 by means of the rotation of the sleeve 430 accompanied by the rotation of the driven roller 420. The restricting blade 450 restricts the amount of toner T retained on the sleeve 430 to a fixed amount along with frictionally charging the toner T to a negative polarity. The toner T frictionally charged by means of the restricting blade 450 is transported to a portion where the sleeve 430 is opposite to the photoreceptor 100 (hereinafter this portion is referred to as "developing region") by means of the rotation of the sleeve 430.

The operation to form an image by means of reverse developing in the image forming apparatus having the above-mentioned construction is described below. The brush charger 200 causes the surface of the rotating photoreceptor 100 to be uniformly charged to −600 V. Then, based on the image information, exposure is carried out by means of the exposure device 300. The exposed portion is decayed to −50 V and the electrostatic latent image is formed. Subsequently, the electrostatic latent image is transported to the developing region by means of the rotation of the photoreceptor 100. Hereupon, a −250 V developing bias voltage is applied to the developing sleeve 430 and electric potential of the surface of the exposed portion of the photoreceptor where the electrostatic latent image thereon is −50 V. Therefore, an electric field is generated between the electrostatic latent image on the photoreceptor and the developing sleeve 430, the toner T on the sleeve 430 adheres to the electrostatic latent image to form a toner image. The toner image is transferred onto the copying paper 700 by means of the transfer charger 500 and then is fixed on the copying paper 700 by a fixing device (not shown in figure).

Conversely, the toner T remaining on the surface of the photoreceptor without adhering to the copying paper during the transfer is uniformly charged by means of the brush charger 200 to −600 V together with the surface of the photoreceptor when the next image formation is performed. Thereafter, based on image information, the charged surface of the photoreceptor is exposed by means of the exposure device 300 and the electrostatic latent image is formed on the exposed portion of the photoreceptor. The formed electrostatic latent image is developed in the developing region to be the toner image. At this time, the electric potential of the surface of the non-exposed portion of the photoreceptor is −600 V, and a −250 V developing bias voltage is applied to the developing sleeve 430 thus, an electric field is generated between the non-exposed portion of the surface of the photoreceptor and the developing sleeve 430.

By the effect of this electric field, the residual toner T adhering to the non-exposed portion of the surface of the photoreceptor adheres to the developing sleeve 430 and the surface of the photoreceptor is cleaned simultaneously with the developing.

Although the cleanerless image forming apparatus having the above construction is highly satisfactory for producing a proper image, when the apparatus has been used for a long time without appropriate maintenance, there is possibility that paper particles of the copying paper adhere to the developing sleeve 430 with the toner which is not transferred to the copying paper. As a result, the frictional charge of the toner on the contact portion with the restricting blade 450 is lowered, thereby the toner T is charged insufficiently. Accordingly, the above cleanerless image forming apparatus leaves room for improvement.

In order to prevent the paper particles collected in this way from being held on the developer support member, Japanese Laid-open Patent Application Hei 5-94093 has disclosed a developing device that removes paper particles along with residual toner collected from the developing roller. In this developing device, inside the hopper is provided the separation roller that makes contact with the developing roller that retains toner frictionally charged to a negative polarity. Because the separation roller is grounded and a developing bias voltage of, for example, −200 V is applied to the developing roller, an electric potential difference is generated between the developing roller and the separation roller. The electric potential difference causes the residual toner and paper particles collected on the developing roller to adhere to the separation roller. Further, the residual toner and paper particles adhering onto the separation roller are scraped off inside the hopper by means of a cleaning blade. The toner and paper particles scraped off inside the hopper are dispersed in the toner contained inside the hopper by means of a transport roller provided inside the hopper.

However, the paper particles mixed with the toner contained inside the hopper of the developing device worsen the fluidity of the toner inside the hopper. The paper particles inside the hopper are further supplied to the developing roller once again along with the toner and make contact with the blade that restricts the amount of toner on the developing roller. The particle sizes of the paper particles at this time are larger than the particle sizes of the toner thus, the restriction force on toner by the blade reduces and poor charging of the toner occurs. As a result, there were problems such as uneven density and lines in the paper-feed direction on the images.

Moreover, when the paper particles which pass through the blade are transported to the developing region by means of the rotation of the developing roller and adhere to the electrostatic latent image, there was also a problem in which only the portion where the paper particles adhere is not developed and a proper image is not formed.

Conversely, when the design was such that developer mixed with paper particles is not reused in order to avoid these problems, wasted developer is increased, resulting in that the design is uneconomical.

SUMMARY OF THE INVENTION

The principal object of the present invention is to provide an image forming apparatus capable of forming a proper image.

Another object of the present invention is to provide an image forming apparatus having a developing device wherein paper particles are removed from the developer held on a developing member for bringing the developer into contact with a photoreceptor.

These objects of the present invention are achieved by providing an image forming apparatus with the following construction.

An image forming apparatus comprising a developing device which develops an electrostatic latent image on a photoreceptor, said developing device comprising:

a rotatable developing member opposite to said photoreceptor at a developing region and holding the developer thereon, said developing member bringing the developer into contact with the photoreceptor at said developing region; and a paper particle removing member provided at a downstream side from the developing region with respect to a rotational direction of the developing member, and which removes paper particles from the developer collected by the developing member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
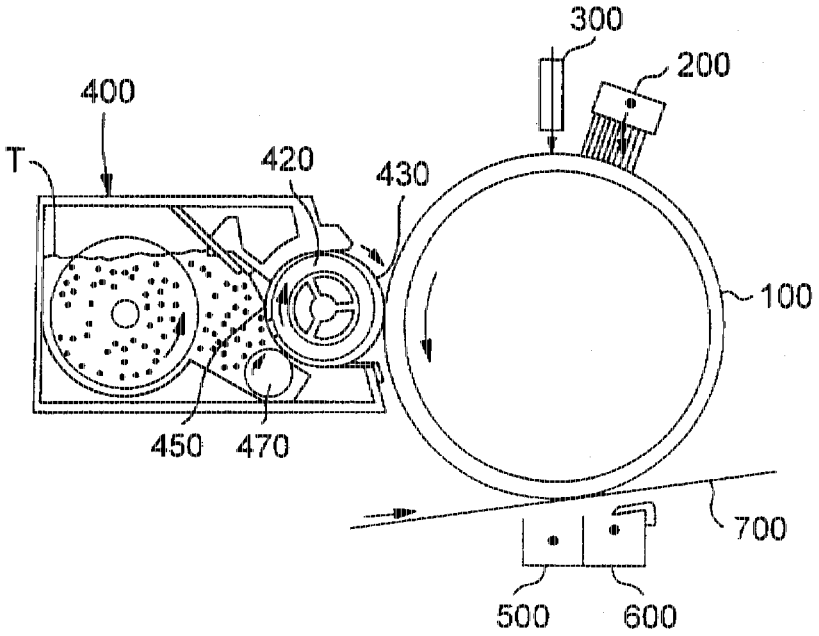
FIG. 1 PRIOR ART
FIG. 1 shows a partial construction of the periphery of the photoreceptor and a cross section of the developing device in a conventional cleanerless image forming apparatus.
Figure 2:
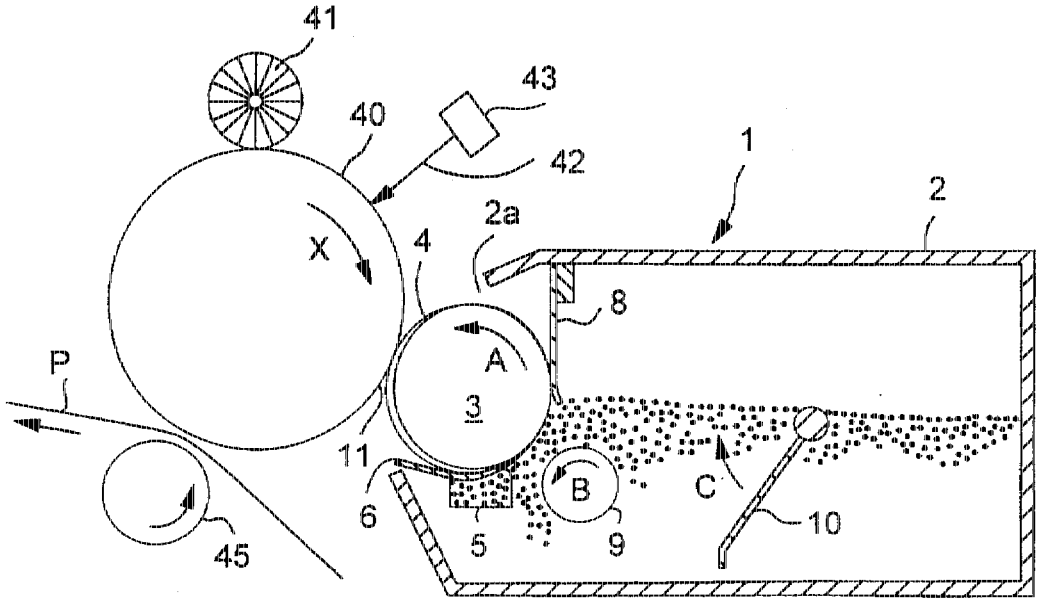
FIG. 2 shows a partial construction of the periphery of the photoreceptor and a cross section of the developing device which is a first embodiment of the present invention in a cleanerless image forming apparatus in which the developing device according to the present invention is applied.

FIG. 2 shows a partial construction of the periphery of the photoreceptor 40 in a cleanerless image forming apparatus in which the developing device of the first embodiment according to the present invention is applied and a cross section of the developing device 1 of the first embodiment.

As shown in FIG. 2., on the periphery of a photoreceptor 40 that rotates in direction X are arranged a charging device 41 comprising a rotatable brush or the like that uniformly charges the surface of a photoreceptor 40, an exposure device 43 that illuminates a laser beam 42 or the like onto the surface of the photoreceptor 40 uniformly charged in accordance with image information to form an electrostatic latent image, a developing device 1 that develops the electrostatic latent image on the photoreceptor using toner and forms a toner image while collecting a residual toner, and a transfer device 45 comprising a transfer roller or the like that transfers the toner image on the photoreceptor to a image-receiving material P such as a paper.

The developing device 1 comprises a casing 2 having an opening 2*a* opposite to the photoreceptor 40. A roller 3 driven to rotate in direction A is provided inside of the opening 2*a*. On the roller 3 is provided with a developing sleeve 4 comprising a conductive thin film cylinder body formed, for example, by aluminum electroforming.

This developing sleeve 4 has a peripheral length slightly longer than the peripheral length of the roller 3 and is brought into contact with the outer peripheral surface of the roller 3 by means of a pressure member (not shown in figure) positioned on both edge sides of the developing sleeve 4. Accordingly, when the developing sleeve 4 is rotated in a direction as shown by an arrow A following the rotation of the roller 3, a slack portion of the developing sleeve 4 is formed in a portion where the roller 3 is opposite to the photoreceptor 40 to contact with the outer peripheral surface of the photoreceptor 40. Further, on the outer peripheral surface of the developing sleeve 4, a very small unevenness is formed. This surface roughness R4 is preferably a ten point surface roughness of approximately 3 to 12 μm and within this range, most preferably 7 μm.

A paper particle removing member 5 is brought into contact with the developing sleeve 4 at the downstream side from a contact region 11 of the photoreceptor 40 and the developing sleeve 4 (hereinafter referred to "developing region") with respect to the rotational direction of the developing sleeve 4. In order to be in pressing contact with the developing sleeve 4, the paper particle removing member 5 is formed by an elastic material with a foam structure sponge construction. Further, urethane foam is more preferable material to be used as the paper particle removing member 5, and silicone rubber may be used as the paper particle removing member 5. It is even more preferable to use an elastic material with a continuous foam structure sponge construction to an elastic material with a single foam structure sponge construction to form the paper particle removing member 5.

It is preferable for the surface roughness R5 of the region where the paper particle removing member 5 is brought into contact with the developing sleeve 4 to be approximately 20 to 100 cells/inch (cells/inch refers to a unit that represents the number of bubbles per 1 inch). However, as described later, if the surface roughness that allows paper particles with large particle sizes compared to the developer (hereinafter referred to as toner) to be removed, but allows the toner to pass through, the surface roughness can deviate outside the above-mentioned range. Moreover, materials other than an elastic material with a foam structure sponge construction can be used to construct the paper particle removing member such as a brush or a mesh if the material removes the paper particles while allowing the toner to pass through.

Furthermore, although the paper particle removing member 5 is removably attached to the casing 2 by means of a mount (not shown in figure), the paper particle removing member 5 may be removably attached to the casing 2 directly.

Figure 3:
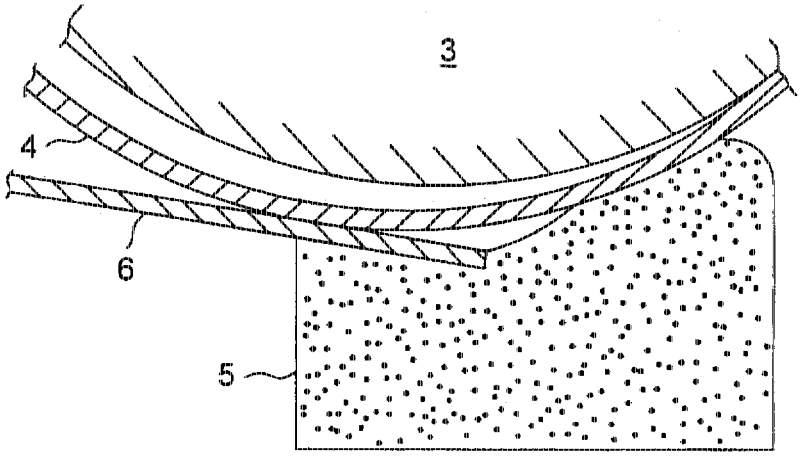
FIG. 3 is an enlarged view of the portion where the paper particle removing member shown in FIG. 2 is brought into contact with the developing sleeve.

A seal member 6 whose leading edge extends to the opening 2*a* of the casing 2 is attached to the paper particle removing member 5 by a fixing method such as adhesion. As shown in FIG. 3, the seal member 6 makes contact with the developing sleeve 4 at the upstream side from the contact region of the paper particle removing member and the sleeve 4 with respect to the rotational direction of the developing sleeve 4. This seal member 6 is, for example, formed from a fluorine contained resin sheet such as polytetrafluoroethylene. It is preferable for the surface roughness R6 of the seal member 6 to be within a range of 0.3 to 2 μm and within this range, more preferably 1 μm. Furthermore, when the fluorine contained resin sheet is frictionally charged, it can be easily charged to a negative polarity, thus when making contact with the toner it is charged to a negative polarity. Therefore, the paper particles charged to a positive polarity opposite to the polarity of the toner become easier to separate from the toner thereby making it effective to form the seal member 6' from a fluorine contained resin sheet.

Further, the seal member 6 is not limited to being fixed to the paper particle removing member 5 as described in this embodiment. For example, it can be fixed to the casing 2. Moreover, the relationship R5>R4>R6 is established for each respective surface roughness R4, R5 and R6 of the developing sleeve 4, the paper particle removing member 5 and the seal member 6.

At portion where the developing sleeve 4 is brought into contact with the outer peripheral surface of the roller 3, one end of a restricting blade 8 which is bent at a certain angle is brought into contact with the developing sleeve 4. The other end of the restricting blade 8 is fixed to the casing 2. This restricting blade 8 uniformly restricts the amount of toner retained on the outer peripheral surface of the developing sleeve 4 along with frictionally charging the toner T to a negative polarity.

Inside the casing 2, a supply roller 9 driven to rotate in direction B is provided. Further, behind the supply roller 9, a stirring blade 10 driven to rotate in direction C is provided.

Inside the casing 2, non-magnetic one-component toner having a frictional charge is contained. While the toner inside the casing is stirred by means of the rotation of the stirring blade 10 it is transported toward the supply roller 9. The toner frictionally charged to a negative polarity by means of making contact with the rotating supply roller 9 electrostatically adheres to the outer peripheral surface of the supply roller 9. The toner retained on the supply roller 9 is transported to the portion where the developing sleeve 4 is opposite to the supply roller 9 by means of the rotation toward direction B of the roller 9. Because, for example, a developing bias voltage of −300 V is applied to the developing sleeve 4, the toner being retained on the supply roller 9 is supplied to the developing sleeve 4.

The toner retained on the outer peripheral surface of the developing sleeve 4 is transported to the restricting blade 8 by means of the rotation toward direction A of the sleeve 4. When the toner passes through the restricting blade 8, the toner on the developing sleeve 4 is frictionally charged further by the contact with the blade while forming a uniform thin toner layer. Then, the toner on the developing sleeve 4 is further transported to the developing region 11.

The operation to form an image by means of reverse developing in a cleanerless image forming apparatus having the above-mentioned construction is described below.

The charging device 41 causes the surface of the rotating photoreceptor to be uniformly charged to, for example, −600 V. Then, based on the image information, exposure is carried out by means of the exposure device 43. The exposed portion on the photoreceptor is decayed to −50 V and the electrostatic latent image is formed. Subsequently, the electrostatic latent image is transported to the developing region by means of the rotation of the photoreceptor 40 and becomes opposite to the developing sleeve 4. A −300 V developing bias voltage is applied to the developing sleeve 4 and the electric potential of the exposed portion on the photoreceptor having the electrostatic latent image thereon is −50 V. Therefore, an electric field is generated between the exposed portion of the photoreceptor and the developing sleeve 4, and the toner on the sleeve 4 adheres to the electrostatic latent image formed at the exposed portion on the photoreceptor to form the toner image. The toner image is transferred to the paper P by means of the transfer device 45 and then is fixed on the paper P by a fixing device (not shown in figure).

Conversely, the toner T remaining on the surface of the photoreceptor without adhering to the copying paper P during the transfer is uniformly charged by means of the charging device 41 to −600 V together with the surface of the photoreceptor during the next image forming operation. Thereafter, based on image information, the charged surface of the photoreceptor is exposed by means of the exposure device 43 and the electrostatic latent image is formed on the exposed portion. The formed electrostatic latent image is developed in the developing region and becomes the toner image. At this time, the electric potential of the non-exposed portion on the photoreceptor is −600 V and a −300 V developing bias voltage is applied to the developing sleeve 4 thus, an electric field is generated between the non-exposed portion on the photoreceptor and the developing sleeve 43. The residual toner T adhering to the non-exposed portion on the photoreceptor are collected with the paper particles by the effect of this electric field, and the developing sleeve 4 and the surface of the photoreceptor is cleaned simultaneously with the developing.

The paper particles and toner (toner not transferred to the paper and toner not used for the developing) adhering to the developing sleeve 4 which pass through the developing region 11 are transported in direction. Then, as described above, the paper particles and toner make contact with the seal member 6 that has a smooth surface thereby smoothly intruding into the contact region of the developing sleeve 4 and the paper particle removing member 5.

Hereupon, because the particle size of the paper particles are approximately 200 μm or more larger than the particle size of the toner which is approximately 6 to 11 μm, the paper particles are removed at the contact surface of the paper particle removing member 5 having a surface roughness of approximately 20 to 100 cells/inch. Conversely, most of the toner passes through without being removed.

Thereafter, a certain amount of toner from which the paper particles were removed is separated from the developing sleeve 4 after passing through the above-mentioned contact region and intermixed with toner contained inside the casing 2. Further, a certain amount of toner is transported to the contact region of the restricting blade 8 and the developing sleeve 4 once again following the rotation of the developing sleeve 4 while adhering to the developing sleeve 4 after passing through the above-mentioned contact region as well.

In this way, according to the developing device 1 of the first embodiment, because it becomes possible to remove only the paper particles from the paper particles and toner adhering to the developing sleeve 4 after developing, there is no mixing of paper particles into the toner contained in the casing 2.

Therefore, image degradation such as uneven density, lines in the paper-feed direction and white strips those caused by toner mixed with paper particles being supplied to the developing sleeve 4 as well as drops in the utilization efficiency of toner due to discarding toner mixed with paper particles can be prevented.

Moreover, the paper particle removing member 5 is removably attached to the casing 2 via a mount. Therefore, if the paper particle removing member is replaced with a new one depending on the degree of image degradation when necessary, for example, when the predetermined number of papers have been printed or other factors, it is possible to maintain the paper particle removing performance at a high level.

Furthermore, in the above-mentioned developing device 1, although a material formed by aluminum electroforming is used as the developing sleeve 4, other material may be also used if the material has conductive properties and a fixed surface roughness. The seal member 6 is not limited to fluorine contained resin sheet, and other material having a fixed surface roughness may be used.

Next, although other embodiments of the present invention will be described, items other than ones specially mentioned are identical to the first embodiment thereby, for corresponding portions, like figures are used and the description omitted.

Figure 4:
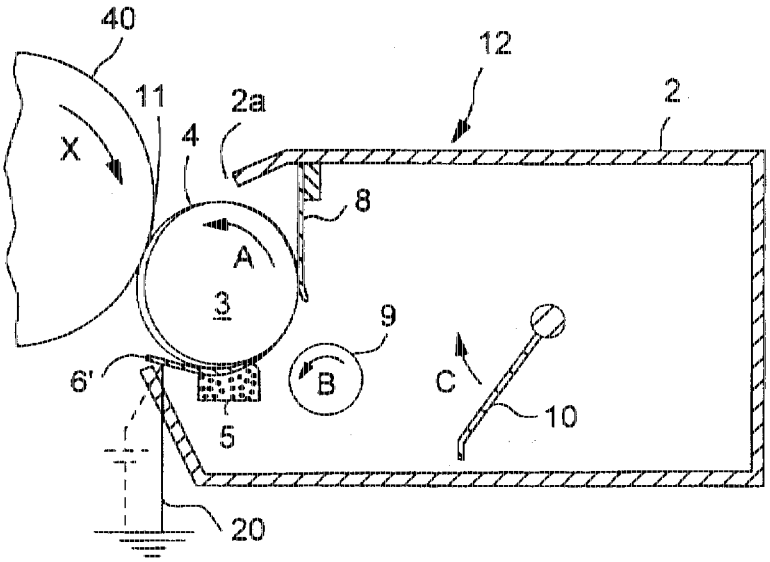
FIG. 4 is a cross-sectional view of the developing device of a second embodiment according to the present invention.

FIG. 4 shows the developing device 12 of the second embodiment according to the present invention. The difference between this developing device 12 and the developing device 1 of the first embodiment is that the seal member 6' has conductive properties and then connected to wiring 20 that grounds the seal member 6'.

When constructed in this way, the toner on the developing sleeve 4 is discharged by means of making contact with the seal member 6' thereby, making it easier to separate the toner from the developing sleeve 4 along with making it easier to separate the toner and paper particles adhered to each other, improving the paper particle removing effect.

Further, as shown by the dotted line in FIG. 3, the same effect can be obtained by applying a voltage opposite to the charge polarity of the toner to the seal member 6' in place of grounding the seal member 6'.

Figure 5:
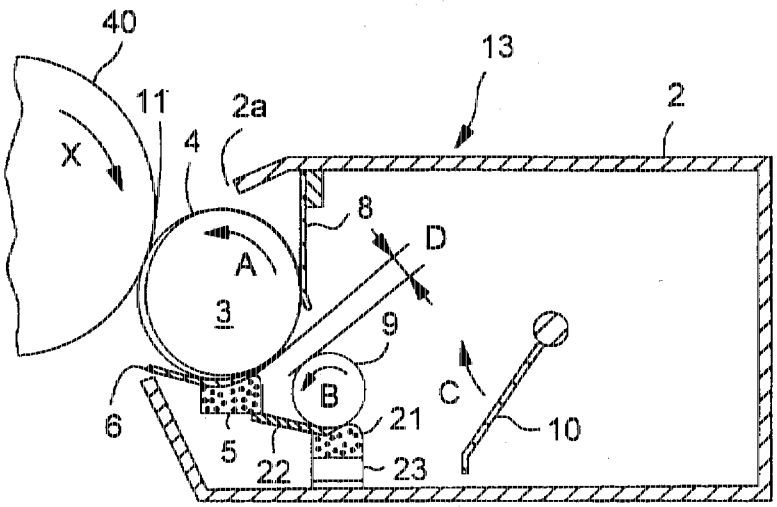
FIG. 5 is a cross-sectional view of the developing device of a third embodiment according to the present invention.

FIG. 5 shows the developing device 13 of the third embodiment according to the present invention. The difference between this developing device 13 and the developing device 1 of the first embodiment is that a second paper particle removing member 21 and a second seal member 22 are provided below the supply roller 9 like the developing sleeve 4 and these two members are removably attached to the casing 2 by means of a mount 23.

Furthermore, the supply roller 9 driven to rotate in direction B is opposite to the developing sleeve 4 at a fixed distance D. The outer peripheral surface of the supply roller 9 moves in the direction opposite to the outer peripheral surface of the sleeve 4 at the opposing portion with the developing sleeve 4, thereby allowing the residual toner and paper particles on the developing sleeve 4 to be separated. Moreover, in order to effectively separate the toner and the paper particles on the developing sleeve 4, it is preferable for the above-mentioned distance D to be within 4 mm.

In the developing device 13 of the third embodiment having the construction described above, even though the paper particles adhering to the developing sleeve 4 are not removed by the paper particle removing member 5 and pass through the member 5, mixing of the paper particles which passed through the member 5 within the toner contained inside the casing 2 is surely prevented. Namely, the paper particles which passed through the paper particle removing member 5 are separated from the developing sleeve 4 by means of the separation action of the supply roller 9. Next, the paper particles are guided to the contact region between the supply roller 9 and a second paper particle removing member 21 by means of a second seal member 22 and then removed by means of the second paper particle removing member 21.

Further, by replacing the above-mentioned paper particle removing member 21 along with the mount 23 with a new one, effective removal of paper particles can be maintained like the above-mentioned paper particle removing member 5.

Figure 6:
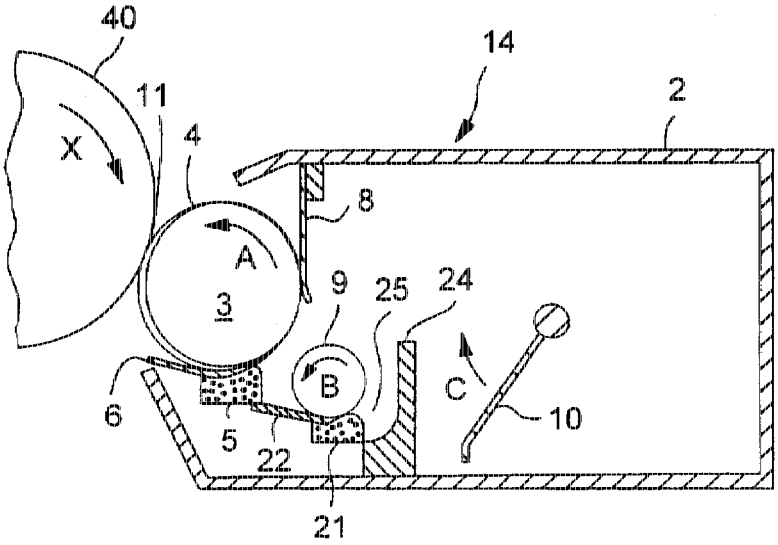
FIG. 6 is a cross-sectional view of the developing device of a fourth embodiment according to the present invention.

FIG. 6 shows the developing device 14 of the fourth embodiment according to the present invention. The developing device 14 has a buffer wall 24 set in an upright position extending from the bottom surface of the casing 2 behind (right side in FIG. 6) the supply roller 9 of the developing device 13 shown in FIG. 5. Because the front bottom portion of this buffer wall 24 is curved and connected to the trailing edge portion of the paper particle removing member 21, a buffer space 25 is formed at the rear of the contact region between the supply roller 9 and the paper particle removing member 21.

When constructed in this way, even though the paper particles which were not removed by means of the paper particle removing member 21 are transported into a toner mass at the downstream side from the paper particle removing member 21 with respect to the rotational direction of the supply roller 9, the fluidity of the paper particles is low compared to the toner, thus the paper particles are accumulated in the buffer space 25. Therefore, scattering of paper particles inside the casing 2 can be prevented even more surely.

Moreover, it is preferable for the height of the buffer wall 24 to be almost the same height as the top of the supply roller 9.

Figure 7:
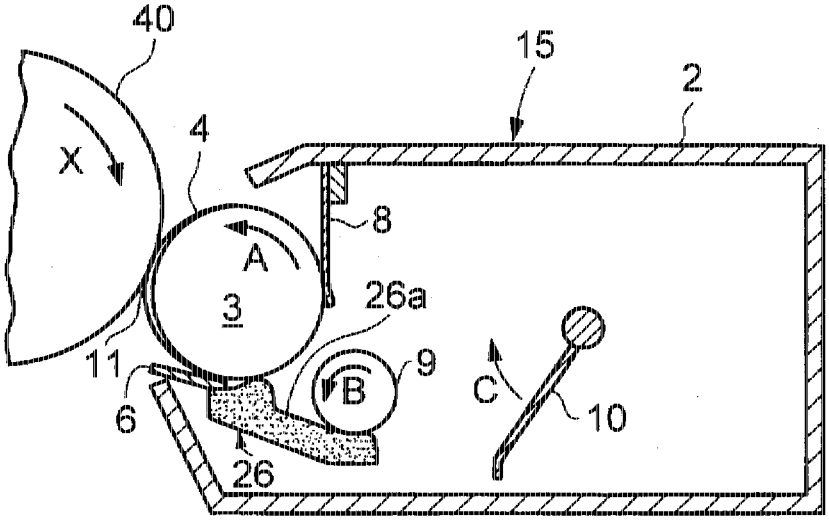
FIG. 7 is a cross-sectional view of the developing device of a fifth embodiment according to the present invention.

FIG. 7 shows the developing device 15 of the fifth embodiment according to the present invention. In the developing device 15 is provided a paper particle removing member 26 integrally formed by the paper particle removing members 5, 21 in the developing device 13 of the above-mentioned third embodiment. The paper particles which passed through the contact region of the developing sleeve 4 and the paper particle removing member 26 are guided to a contact region between the supply roller 9 and the paper particle removing member 26 via an inclined portion **26*a* of the paper particle removing member 26. By providing the paper particle removing member 26 integrally formed by the paper particle removing members 5, 21 in the developing device 13 in this way, the seal member 22 in the developing device 13** also becomes unnecessary. Therefore, the number of parts used to construct the developing device can be reduced allowing simpler construction.

Figure 8:
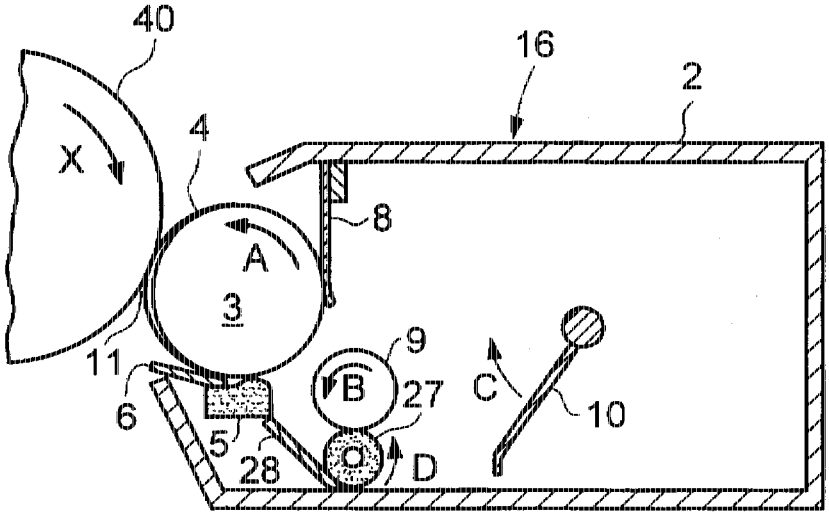
FIG. 8 is a cross-sectional view of the developing device of a sixth embodiment according to the present invention.

FIG. 8 shows the developing device 16 of the sixth embodiment according to the present invention. The developing device 16 is provided with a paper particle removing roller 27 driven to rotate in direction D while being contacted with the supply roller 9. The outer diameter of the paper particle removing roller 27 is almost the same as the supply roller 9. Further, the peripheral speed of the paper particle removing roller 27 may be slower than the peripheral speed of the supply roller 9. Even further, if there is difference in peripheral speed between the supply roller 9 and the paper particle removing roller 27, the rotation direction of the paper particle removing roller 27 may be the direction opposite to direction D.

Furthermore, a seal member 28 is arranged which extends to the bottom surface of the casing 2 under the paper particle removing roller 27 from the trailing edge portion of the paper particle removing member 5 which is making contact with the developing sleeve 4.

In this way, by proving not a fixed type but a rotation type of the paper particle removing member contacting with the supply roller 9, the paper particles which were not removed by the paper particle removing member 5 can be effectively removed even better. Namely, the paper particles separated from the developing sleeve 4 by means of the supply roller 9 after passing through the paper particle removing member 5 either intrude into the contact region of the supply roller 9 and the paper particle removing roller 27 and is removed or are guided to the lower portion of the paper particle removing roller 27 by means of the seal member 28 and then removed thereby, allowing the paper particles to be effectively and surely removed even more.

Figure 9:
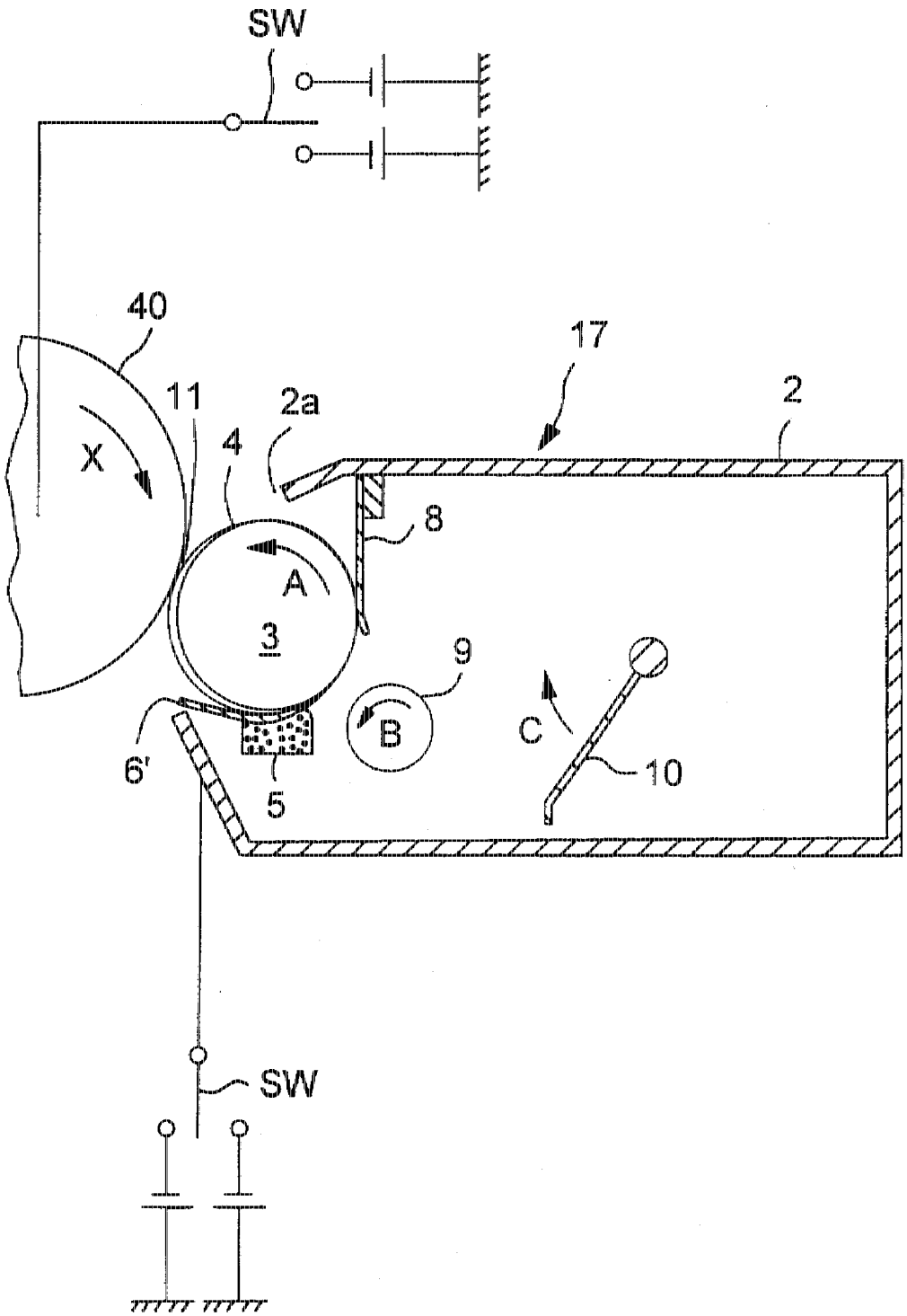
FIG. 9 is a cross-sectional view of the developing device of a seventh embodiment according to the present invention.

FIG. 9 shows the developing device 17 of the seventh embodiment according to the present invention. The developing device 17 has an identical construction as the developing device 12 of the second embodiment except for a different voltage polarity applied to the developing sleeve and a different amount of voltage applied to the seal member 6' between when an image is not being formed and when an image is being formed.

When an image is being formed, a developing bias voltage of −300 V is applied to the developing sleeve 4 of the developing device 17 and a voltage of −300 V is applied to the conductive seal member 6'. Conversely, when an image is not being formed, a developing bias voltage of +300 V is applied to the developing sleeve 4 of the developing device 17 and a voltage of −200 V is applied to the seal member 6'.

When an image is not being formed, the toner remaining on the photoreceptor 40 can be collected by the developing sleeve 4 more surely by applying to the developing sleeve 4 the voltage having an opposite charging polarity to that of the toner. Further, because the paper particles on the developing sleeve 4 are charged to a positive polarity opposite to the polarity of the toner, a voltage having a negative polarity opposite to the polarity of the paper particles is applied to the seal member 6' thereby making it easier to separate paper particles and toner adhering to the developing sleeve 4. As a result, the paper particles within the toner collected by the developing sleeve 4 can be removed more surely.

Moreover, it is preferable that surface roughness of the paper particle removing members 21, 26 or 27, surface roughness of the seal member 22 or 28, and surface roughness of the supply roller 9, and the relationship among the above surface roughnesses in the third through sixth embodiments are respectively similar to the surface roughness of the paper particle removing member 5, surface roughness of seal member 6 and surface roughness of developing sleeve 4, and the relationship among them in the first embodiment.

Furthermore, although a paper particle removing member is provided for both the developing sleeve 4 and the supply roller 9 in the above-mentioned embodiments 3 to 6, the paper particle removal effect can be obtained even if a paper particle removing member is provided for the supply roller 9 only.

Even further, in order to more surely prevent the paper particles from being dispersed in the toner contained inside the casing 2, the buffer wall 24 may be provided to form a buffer space 25 in the developing devices 15, 16 of the fifth and sixth embodiments like the developing device 14 of the fourth embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A mono-component developing device which collects a developer remained on a photoreceptor without being transferred to a recording sheet in an image forming apparatus, said mono-component developing device comprising:

a rotatable developing member opposite to the photoreceptor at a developing region, and which transports the developer while holding the developer thereon to bring the developer into contact with the photoreceptor at the developing region;

a paper particle removing member in pressing contact with the developing member at a downstream side from the developing region with respect to a rotational direction of the developing member, and which removes paper particles from the developer collected by the developing member; and a seal member one end of which contacts with the developing member while the other end of which contacts with the surface of said paper particle removing member.

2. A developing device as claimed in claim 1 wherein surface roughness of the paper particle removing member is greater than surface roughness of the developing member, and surface roughness of the developing member is greater than surface roughness of the seal member.

3. A developing device as claimed in claim 1 wherein the surface roughness of the paper particle removing member in pressing contact with the developing member is approximately 20 to 100 cells/inch.

4. A developing device as claimed in claim 1 wherein the seal member has conductive properties, and the seal member is grounded or applied with a voltage having a polarity opposite to a charge polarity of the developer.

5. A developing apparatus as claimed in claim 1 wherein said seal member has conductive properties, and further comprising:

a first applying member which applies to the seal member a voltage having the same polarity as a charge polarity of the developer; and a second applying member which applies a voltage to the developing member, the voltage having the same polarity as the charge polarity of the developer being applied to the developing member by the second applying member when an image formation is performed in the image forming apparatus, while the voltage having a polarity opposite to the charge polarity of the developer being applied to the developing member by the second applying member when the image formation is not performed in the image forming apparatus.

6. A developing device as claimed in claim 1 further comprising:

a casing which accommodates the developer therein;

a rotatable supply member provided in said casing and which supplies the developer onto the developing member;

a second paper particle removing member being in pressing contact with said supply member and having a predetermined surface roughness; and a second seal member one end of which contacts with the back surface of the paper particle removing member and the other end of which contacts with the surface of the second paper particle removing member.

7. A developing device as claimed in claim 6 wherein surface roughness of the second paper particle removing member is greater than surface roughness of the supply member, and surface roughness of the supply roller is greater than surface roughness of the second seal member.

8. A developing device as claimed in claim 6 wherein the paper particle removing member, the second seal member and the second paper particle removing member are integrally formed.

9. An image forming apparatus comprising a developing device which collects a developer remained on a photoreceptor without being transferred on a recording sheet, said developing device comprising:

a casing which accommodates the developer therein;

a rotatable developing member opposite to the photoreceptor at a developing region, and which transports the developer in the casing while holding the developer thereon to bring the developer into contact with the photoreceptor at the developing region; and a paper particle removing member provided in the casing which removes paper particles from the developer collected and transported into the casing by the developing member and configured so as to prevent the removed paper particles from mixing with the developer in the casing.

10. An image forming apparatus as claimed in claim 9 wherein said developing device develops the electrostatic latent image on the photoreceptor with a mono-component developer.

11. An image forming apparatus as claimed in claim 9 wherein said paper particle removing member is in pressing contact with the developing member at a downstream side from the developing region with respect to a rotational direction of the developing member and has a predetermined surface roughness, and said paper particle removing member is provided with a seal member one end of which contacts with the surface of the paper particle removing member while the other end of which contacts with the developing member.

12. An image forming apparatus as claimed in claim 11 wherein surface roughness of the paper particle removing member is greater than surface roughness of the developing member, and surface roughness of the developing member is greater than surface roughness of the seal member.

13. An image forming apparatus as claimed in claim 11 wherein the surface roughness of the paper particle removing member in pressing contact with the developing member is approximately 20 to 100 cells/inch.

14. An image forming apparatus as claimed in claim 11 wherein the seal member has conductive properties, and the seal member is grounded or applied with a voltage having a polarity opposite to a charge polarity of the developer.

15. An image forming apparatus as claimed in claim 11 wherein said seal member has conductive properties, and further comprising:

a first applying member which applies a voltage having the same polarity as a charge polarity of the developer to the seal member; and a second applying member which applies a voltage to the developing member, the voltage having the same polarity as the charge polarity of the developer being applied to the developing member by said second applying member when an image formation is performed, while the voltage having a polarity opposed to the charge polarity of the developer being applied to the developing member by the second applying member when the image formation is not performed.

16. An image forming apparatus as claimed in claim 11 wherein the developing device further comprising:

a rotatable supply member provided in the casing and which supplies the developer in the casing to the developing member;

a second paper particle removing member which is in pressing contact with said supply member and having a predetermined surface roughness; and a second seal member one end of which contacts with the back surface of the paper particle removing member and the other end of which contacts with the surface of the supply roller.

17. An image forming apparatus as claimed in claim 16 wherein surface roughness of the second paper particle removing member is greater than surface roughness of the supply member, and surface roughness of the supply member is greater than surface roughness of the second seal member.

18. An image forming apparatus as claimed in claim 16 wherein the paper particle removing member, the second seal member and the second paper particle removing member are integrally formed.

19. An image forming apparatus as claimed in claim 9 wherein the developing device further comprising:

a rotatable supply member provided in the casing and which supplies the developer in the casing to the developing member, said paper particle removing member being in pressing contact with said supply member and having a predetermined surface roughness; and a seal member one end of which contacts with the surface of the paper particle removing member while the other end of which is in pressing contact with the developing member.

20. An image forming apparatus as claimed in claim 9, wherein the paper particle removing member is located so as to remove paper particles from a developer residing on the rotatable developing member.

21. An image forming apparatus as claimed in claim 9, wherein the paper particle removing member is located downstream of the developing region and upstream of a location in the casing where the developer in the casing is transported to the rotatable developing member.

22. A developing device which develops an electrostatic latent image formed on a photoreceptor in an image forming apparatus, said developing device comprising:

a rotatable developing member opposite said photoreceptor at a developing region and holding a developer thereon, said developing member bringing the developer into contact with the photoreceptor at said developing region; and a paper particle removing member in contact with the developing member at a downstream side of the developing region with respect to a rotational direction of the developing member and formed of an elastic material, and which removes paper particles from the developer held on the developing member.

23. A developing device as claimed in claim 22 wherein said developing member collects the developer remained on the photoreceptor without being transferred to a recording sheet.

24. A developing device as claimed in claim 22 wherein said developing device develops the electrostatic latent image on the photoreceptor with a mono-component developer.

25. A developing device as claimed in claim 22 further comprising:

a casing which accommodates the developer therein; and a rotatable supply member provided in said casing and which supplies the developer onto the developing member, said paper particle removing member being in pressing contact with at least either of the developing member or the supply member and having a predetermined surface roughness, and said paper particle removing member being provided with a seal member one end of which contacts with the surface of the paper particle removing member while the other end of which contacts with the developing member.

26. A developing device as claimed in claim 25 wherein surface roughness of the paper particle removing member is greater than surface roughness of the developing member or the supply member, and surface roughness of the developing member or the supply member is greater than surface roughness of the seal member.

27. A paper particle removing member for removing paper particles directly from a developer on a roller in a developing device that transfers the developer to a photoreceptor, said paper particle removing member being formed of an elastic material with a foam structure sponge construction.

28. A paper particle removing member as claimed in claim 27 wherein said elastic material includes urethane foam.

29. A paper particle removing member as claimed in claim 27 wherein said elastic material has surface roughness of approximately 20 to 100 cell/inch.

30. A paper article removing member as claimed in claim 27 wherein said elastic material is in pressing contact with a surface of the roller in the developing device.

31. A paper particle removing member as claimed in claim 27 wherein the roller includes a sleeve, the paper particle removing member for removing the paper particles directly from the sleeve.

32. A paper particle removing member as claimed in claim 27, wherein the paper particle removing member is located downstream of a developing region and upstream of a location where the developer is transported to the roller.

33. The paper particle removing member according to claim 27, in combination with a further paper particle removing member, the further paper particle removing member for removing paper particles directly from a rotatable developer supporting member.

34. The paper particle removing member according to claim 33, wherein the rotatable developer supporting member is a roller in a developing device that supplies the developer to a developing sleeve.

35. The paper particle removing member according to claim 33, wherein the paper particle removing member and the further paper particle removing member are integral.

* * * * *